US008489358B2

(12) United States Patent
Petronilho et al.

(10) Patent No.: US 8,489,358 B2
(45) Date of Patent: Jul. 16, 2013

(54) METHOD FOR DETERMINING LOADS IN CLOTHES WASHING MACHINES

(76) Inventors: Andre Petronilho, Sao Carlos (BR); Marcelo Andrade Dias, Rio Claro (BR)

( * ) Notice: Subject to any disclaimer, the term of this patent is extended or adjusted under 35 U.S.C. 154(b) by 59 days.

(21) Appl. No.: 12/964,328

(22) Filed: Dec. 9, 2010

(65) Prior Publication Data

US 2011/0202303 A1 Aug. 18, 2011

(30) Foreign Application Priority Data

Dec. 9, 2009 (BR) ..... 0905317

(51) Int. Cl.

| | |
|---|---|
| ***G01P 15/00*** | (2006.01) |
| ***G01P 3/00*** | (2006.01) |
| ***G01P 11/00*** | (2006.01) |
| ***D06F 33/00*** | (2006.01) |
| ***D06F 33/02*** | (2006.01) |

(52) U.S. Cl.

USPC ..... 702/145; 702/141; 702/146; 68/12.02; 68/12.04

(58) Field of Classification Search

USPC ..... 702/33, 34, 142, 145, 146; 68/12.01, 68/12.02, 12.04, 12.06, 12.16

See application file for complete search history.

(56) References Cited

U.S. PATENT DOCUMENTS

| | | | | |
|---|---|---|---|---|
| 5,241,845 | A | 9/1993 | Ishibashi et al. | |
| 6,038,724 | A | 3/2000 | Chbat et al. | |
| 6,505,369 | B1 * | 1/2003 | Weinmann | 8/159 |
| 7,162,759 | B2 * | 1/2007 | Weinmann | 8/158 |
| 7,296,445 | B2 * | 11/2007 | Zhang et al. | 68/12.06 |
| 7,739,764 | B2 * | 6/2010 | Zhang et al. | 8/159 |
| 8,186,227 | B2 * | 5/2012 | Ashrafzadeh | 73/760 |

* cited by examiner

*Primary Examiner* — Michael Nghiem
*Assistant Examiner* — Ricky Ngon
(74) *Attorney, Agent, or Firm* — Brian Colandreo; Jeffrey T. Placker; Holland & Knight LLP

(57) ABSTRACT

The present invention refers to a method for determining loads in clothes washing machines which comprises the following steps: (E1) Acceleration of the mobile assembly of the washing machine until the mobile assembly reaches a low rotation speed; (E2) Acceleration of the mobile assembly until the mobile assembly reaches a medium rotation speed faster than the speed in the first step (E1); (E3) Deceleration; (E4) Acceleration of the mobile assembly and measurement of the engine current; (E5) Measurement, whereby parameters regarding the engine are measured; (E6) Shutdown of the engine and measurement of the deceleration time; (E7) Repetition, whereby the forth (E4), fifth (E5) and sixth (E6) steps are repeated at least once before the performance of the eighth step (E8); (E8) Calculation of the average of each one of the parameters measured in the fourth, fifth, sixth and seventh steps; and (E9) Obtainment of clothes load value.

10 Claims, 5 Drawing Sheets

METHOD FOR DETERMINING LOADS IN CLOTHES WASHING MACHINES

FIELD OF THE INVENTION

The present inventions refers to a method for determining loads in clothes washing machines which, based on the operational parameters of the electronic engine of said washing machine determines the clothes load.

BACKGROUND OF THE INVENTION

Methods for measuring or estimating the load in a clothes washing machine are frequently found in the state of the art. These methods are of paramount importance as through the measurement of the clothes load it is possible to program the washing time and quantity of water used for the operations of a washing machine more precisely. Consequentially, it is also possible to save water and electrical energy, which has been a frequent and common concern with many technological developments, not just those which belong to the same field as the present invention.

Besides introducing advantages from an economic viewpoint, the methods of load measurement of the state of the art have been used together with control systems to automate operations of the washing machine, bringing practical advantages to the user.

As an example of the state of the art for a method of load measurement for washing machines, patent document U.S. Pat. No. 5,241,845 may be cited. This document describes a method which estimates the clothes load in washing machines from the measurement of the difference of phase angle between the engine current phase and the voltage supply phase of the same. Thus, this document sustains that the decrease of the difference of the phase angle is proportional to the potency of the engine. As such, considering that the engine potency is proportional to the volume of clothes to be washed, the changing of the phase angles is associated with the quantity of clothes in the basket of the washing machine.

Beyond this measurement characteristic, the method described in this US document uses other variables to automate the operation of the washing machine, such as: type of clothes, volume of detergent, type of detergent, transparency of the water and temperature of the water. There is at least one sensor and at least one circuit associated to each of these variables. As such, the method combines these variables through a neural network, to achieve the objective of controlling the washing operations of the washing machine.

As you can see, the method described in this patent U.S. Pat. No. 5,241,845 takes many variables beyond the clothes load into consideration to automate the operation of the washing machine. Although these other variables bring advantages to the consumer, the implementation cost of this method is high, considering the number of components necessary to measure and deal with the variables.

Another example of the state of the art is contained in patent document U.S. Pat. No. 6,038,724. This document describes a method which estimates the clothes load in a washing machine from variables of position and speed. More specifically, the method calculates the clothes load's moment of inertia based on the acceleration of the mobile assembly (in this case, stirrer) and the engine phase angle.

Throughout the text of document U.S. Pat. No. 6,038,724 it is stated that the method described requires a simple system of sensors and a controller for its viability. However, despite the method being able to be implemented through low cost components, it should be noted that the calculation of the moment of inertia presented by this document does not take into consideration that the load distribution within the mobile assembly influences the value which this quantity adopts. Besides this, the fact that other factors can influence the acceleration of the mobile assembly, such as, for example, the temperature of the engine, is also not taken into consideration. Therefore, the load estimate that does not take into account these characteristics of the moment of inertia is imprecise, and, therefore, needs to be improved in order to be employed successfully by those skilled in the art.

In this sense, it should be noted that the state of the art still does not include a method for the estimation of clothes load which is efficient and, at the same time, has low implementation cost.

Objectives of the Implementation

Therefore, providing a method to measure the clothes load in a washing machine which is efficient, reliable and robust while being low cost is an objective of the present invention.

SUMMARY OF THE INVENTION

The objectives of the present invention are achieved through a method of load measurement in washing machines which comprises the following steps: acceleration of the mobile assembly of the washing machine until the mobile assembly reaches a low rotation speed; acceleration of the mobile assembly until the mobile assembly reaches a medium rotation speed faster than the speed of the first step; shutdown of the engine, whereby the engine which turns the mobile assembly is turned off; acceleration of the mobile assembly until it reaches a low speed, whereby the speed of the engine which turns the mobile assembly is increased up to a predetermined rotation speed limit; measurement, whereby parameters relative to the engine are measured; acceleration of the mobile assembly until it reaches a medium speed, whereby the engine current is measured; shutdown of the engine and measurement of the deceleration time, whereby said engine is turned off and turns through inertia and the time spent from the shutdown up to a pre-determined minimum speed limit is reached, is measured; repetition, whereby, the following steps are repeated at least once: acceleration of the mobile assembly until it reaches a low rotation speed; measurement, acceleration of the mobile assembly until it reaches a medium speed and shutdown of the engine and measurement of the deceleration time, calculation of the average of each one of the parameters measured in the previous step; and obtainment of the clothes load value based on the values obtained in the previous step.

DETAILED DESCRIPTION OF THE INVENTION

Figure 3:
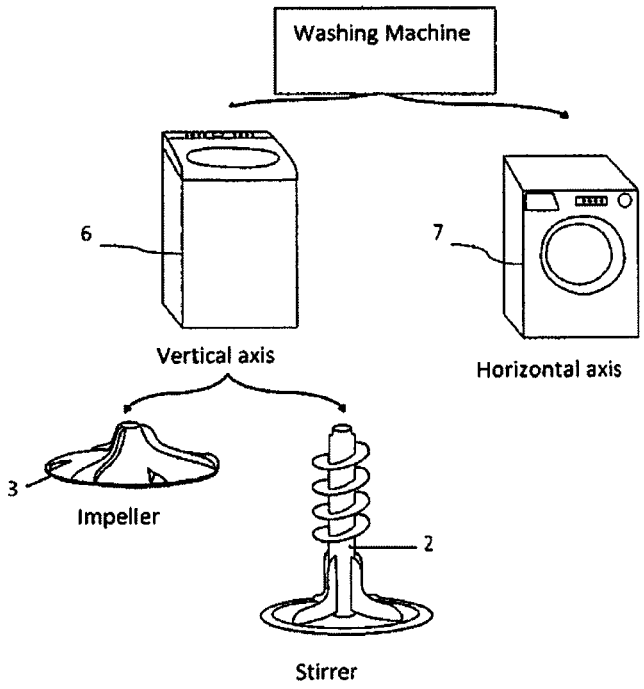
FIG. 3—The types of washing machine upon which the method of the present invention may be implemented.

As you can see from FIG. 3, the types of washing machine to which the present invention can be applied are illustrated. Preferably, but not exclusively, the method of the present invention is applied to a washing machine with a vertical axis 6, as well as those which possess stirrer 2 or impeller 3.

Figure 4:
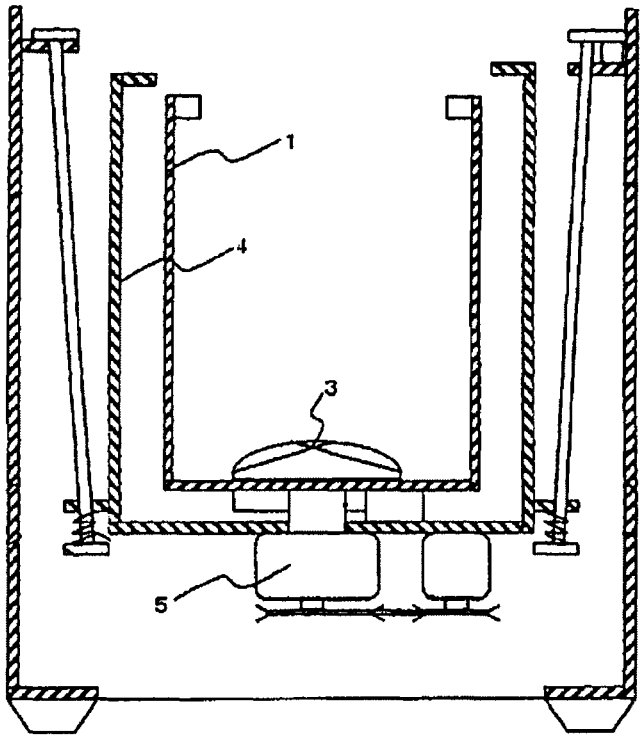
FIG. 4—A sectional view of a washing machine with a vertical axis.

In this respect, to support the description of the method of the present invention, a conventional washing machine shall be briefly described based on FIG. 4. A conventional washing machine, which may benefit from the method for determining loads of the present invention, comprises, basically, a mobile assembly, an engine 5, a source of power for the engine and a control module.

The mobile assembly, for the purposes of this invention, may consist of a basket 1 and on the machines with a vertical axis 6 by a stirrer 2 or impeller 3 located within a tank 4. The basket is the component of the washing machine in which the clothes are arranged for the realization of washing. Besides this, the basket may be associated with an electric engine 5 so as to move angularly in order to centrifuge the garments inside and, therefore, remove the excess of water from the clothes via holes existing on its side wall, which accelerate the drying process. The tank, on its part, is a reservoir in which water, detergents and other products related to washing clothes are added. Besides this, the stirrer is generally elongated and the impeller has the format of a plate with protrusions, with it being that both project from the base of the basket 1 in an upwards direction, also being able to be associated to an electric engine 5 in order to move angularly and promote the friction between the items of clothing inside the basket.

In this respect, therefore, it should be understood that the term "mobile assembly", used throughout the description of the invention, refers to the parts of the clothes washing machine which move, and may be, depending on the model of the washing machine, the basket and the stirrer 2 or impeller 3.

On its part, the engine 5, in the case of an electric engine, is responsible for moving the mobile assembly. In the context of the present invention, the electric engine 5 is a conventional washing machine engine. The engine's source of power is, preferably, the electrical energy network, nevertheless, it may be comprised by other means of power which are not the electrical energy network and which meet the specifications of the engine. The engine control module, on the other hand, comprises a control circuit to control the starting, the operation, and the stopping of the engine, based on the washing functions of the washing machine. Besides this, the control module comprises means for storing variables and parameters shown for the performing of procedures and functions which involve, for example, the regulation of the amount of water present in the basket or, even, the time necessary for each operation of the washing machine. In the case of the present invention, the control module is, additionally, responsible for the control and execution of the steps provided, which involves, beyond the control of the operation itself, the performance of calculations, acquisition of parameters and provision of an exit, i.e., the availability of the clothes load present in the washing machine.

The conventional washing machines may furthermore comprise means which will transmit the engine rotation 5 to the mobile assembly, these means comprising, generally, a belt.

Since the invention has been put into context, below, its preferential embodiments shall be explained based on the Figures.

Initially, considering that a user adds a given amount of clothes to the inside of the basket of the washing machine and selects one of the washing options of the machine, the method of the present invention is activated, by actuating the control module, preferably, before the start of the actual washing of clothes. As such, bearing in mind that some small items of clothing may be thrown out of the basket due to being only slightly wet or covered only slightly by water, the method of the present invention provides in its first step E1 a constant increase of water over the clothes.

As such, the first step E1 comprises an acceleration of the mobile assembly, from the pause, until it reaches a low rotation speed, preferably between 25 and 50 rpm, with it being that, as the mobile assembly is being accelerated, a given quantity of water, around 2 liters, is poured over the clothes. Thus, any small item of clothing being eventually thrown out of the basket is avoided. Despite preferential rotational speed values and volumes of water being cited, it should be understood that these values may vary depending on the type of engine being used or, furthermore, depending on other project variables.

After avoiding the problem with the small items of clothing, the method of the present invention continues to the second step E2, in which the mobile assembly is again accelerated, however, this time, up to a medium rotation speed, preferably between 150 and 200 rpm, this medium speed being faster than the speed of the first step E1. The objective of spinning the mobile assembly to this medium speed is to disperse the clothes around the basket in order to improve the distribution of the load and, consequentially, minimize the variations at the moment of inertia of this load. The variations at the moment of inertia of the load prejudice the precise measurement of the parameters to be used in the present invention, since the moment of inertia of the load influences the rotation and acceleration of the engine, as, for example, a large moment of inertia causes a slower acceleration.

Since the load is duly immersed in water and distributed in a more uniform way, the engine that turns the mobile assembly is turned off, causing the mobile assembly to decelerate until it stops. This deceleration corresponds to the third step E3 of the method of the present invention.

Figure 1:
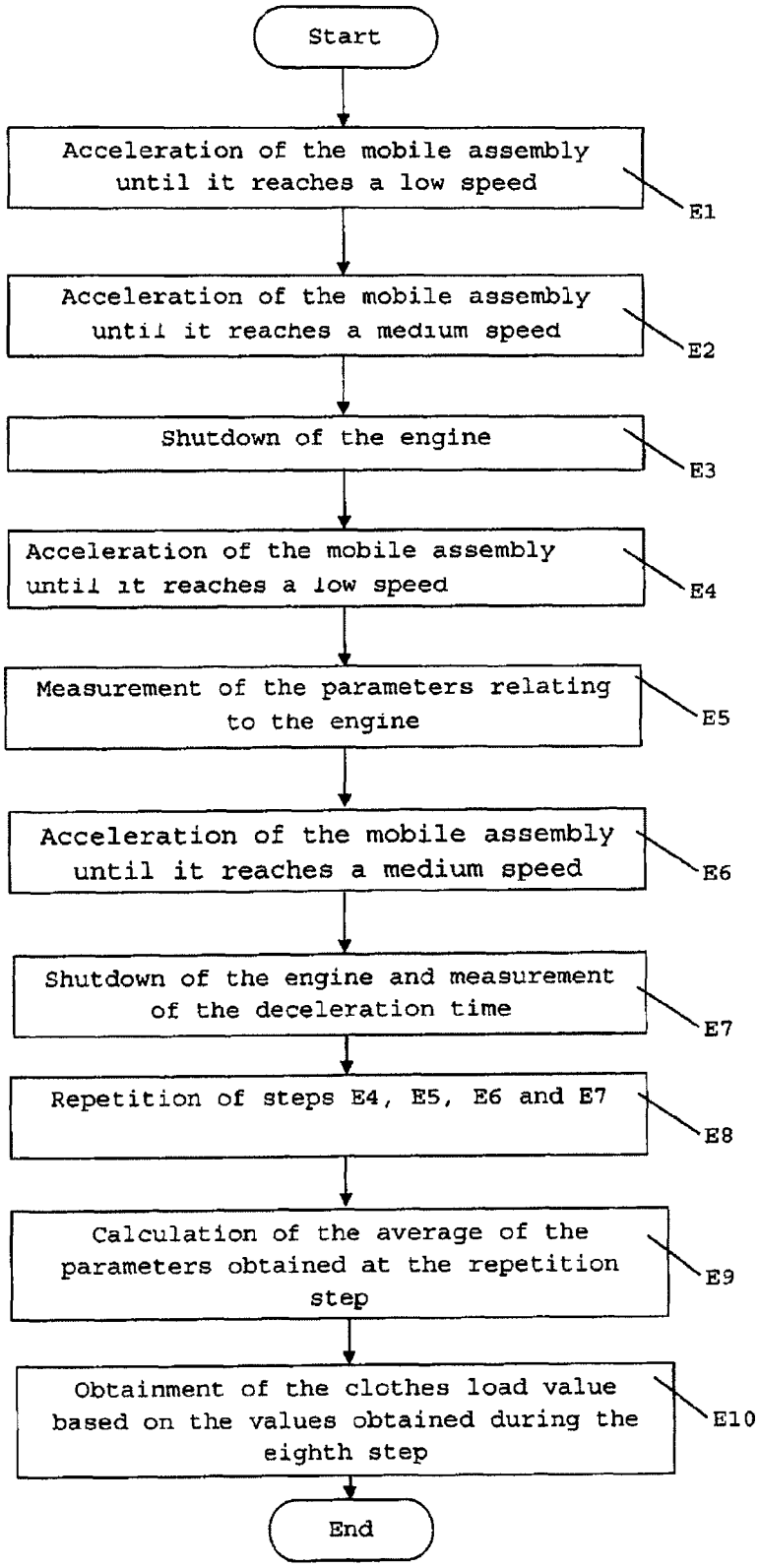
FIG. 1—A flowchart that illustrates the first preferential embodiment of the method of the present invention.
Figure 2:
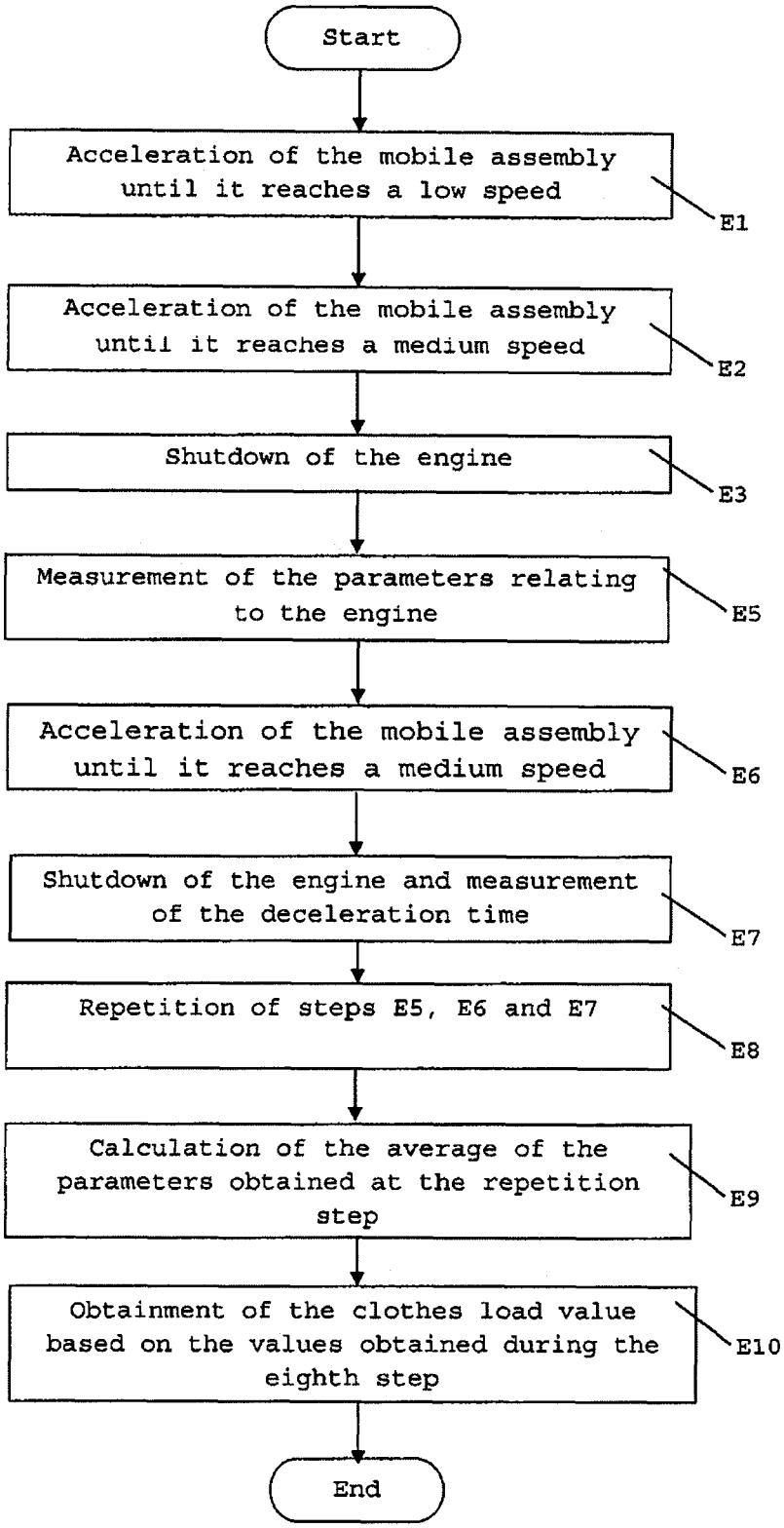
FIG. 2—A flowchart that illustrates the second preferential embodiment of the method of the present invention.

In the forth step E4 of the method of the present invention the mobile assembly is again accelerated up to a low rotation speed, preferably between 25 and 50 rpm, this is done so that the mobile assembly leaves the stationary state and ignores the static friction which may generate more noise in the measurements. Besides this, for the application of the method of the present invention to machines in which the coupling between the mechanism and the axis of the engine is done by an actuator, this step E4 of acceleration of the mobile assembly until a low speed is reached may be eliminated. The objective of imposing a low speed upon the mobile assembly is to verify whether the mechanism is correctly engaged. FIG. 2 illustrates the second preferential embodiment of the present invention.

In the fifth step E5 of the method, the parameters relating to the engine are measured. This measurement occurs during the acceleration E4 of the mobile assembly at a low speed, being described here as a separate step with the objective of clarifying the explanation of the functioning of the invention. In the embodiment of the invention that does not use the acceleration step E4 of the mobile assembly to a low speed the measurement is done with the engine stopped, which occurs after the step of engine shutdown E3.

As you can see, the present invention does not perform the measurement or calculation at the moment of inertia of the clothes load directly, and it indeed measures the amount of energy spent by the engine to accelerate the mobile assembly, with the load inside, from a lower to a higher speed, with the energy being obtained by measuring the engine current with a constant sampling rate and summing this current while the engine is accelerating the mobile assembly until it reaches a desired speed.

In this step the parameters measured by sensors present in the machine are: line voltage, engine temperature and engine control module temperature. In the following steps the engine current and the deceleration time of the mobile assembly are to be measured to compose the entry variables necessary to the measurement of clothes load.

After having measured the parameters, the mobile assembly is again accelerated in the sixth step E6 of the present invention until a medium speed is reached. In this step, the speed of the engine that turns the mobile assembly is increased up to a pre-determined rotation speed limit, preferably around 170 rpm, but other speeds may be used depending on the necessities of the application.

Figure 5:
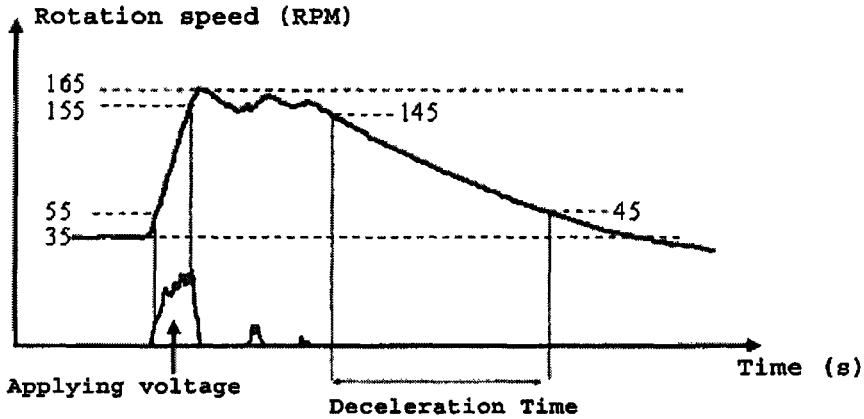
FIG. 5—A graphic which represents the behavior of the engine, in terms of rotation speed, in relation to time, in the fifth and sixth steps of the method of the present invention.

More precisely, in the sixth step E6 the engine is accelerated from a low rotation speed, as can be seen in FIG. 5. The preferential value of this low speed is 35 rpm. As such, through the application of a variable engine supply voltage, the control module of the machine tries to maintain a constant acceleration rate. Consequentially, the greater the load in the basket of the machine the more energy is necessary to have the same acceleration rate, compared with a situation of little load in the basket, which makes the engine current proportional to the load amount in the basket. The control module maintains the application of said voltage supply until the engine reaches a pre-determined rotation speed, this being preferably 165 rpm. When this value is reached, the method of the present invention advances to the seventh step E7.

Even during this acceleration stage E6 the engine current is measured. Preferably, the engine current is measured between 55 and 155 rpm, as can be seen in FIG. 5. Nevertheless, other values may be adopted, depending on the needs and restrictions of the application, with it being wise to bear in mind that higher speeds help in the differentiation of loads, but amplify the problem of throwing small items of clothing outside the machine.

After reaching the maximum rotation speed value the method of the present invention, as already mentioned, proceeds to the seventh step E7. In this seventh step E7, the engine which turns the mobile assembly is shutdown, causing the turning of the mobile assembly by inertia. From the moment of shutting down the engine, the deceleration time is measured, i.e., the time which the mobile assembly takes to reach a pre-determined minimum speed limit. This time interval is also a parameter used for the determination of the clothes load that is in the basket.

It is important to note that the shutdown of the engine in the seventh step E7 may not necessarily occur when its rotation speed reaches the pre-determined maximum speed limit (end of the sixth step E6). There may be a time interval between the instance in which the maximum limit is reached and the instance in which the engine is shutdown, so that the speed of the mobile assembly can stabilize. The preferable case illustrated in FIG. 5, shows that there is this said time interval until the engine is shutdown. It should be understood that this characteristic is not a factor which limits the scope of the present invention.

After acquiring this parameter, the method of the present invention continues to the eighth step E8 which is the repetition of the forth E4, fifth E5, sixth E6 and seventh E7 steps at least once before the performance of the following step. The objective of these repetitions is to form a selection of data for each parameter, as such, it being possible, from the calculation of the average of each of these parameters, to obtain reliable values for the determination of the load.

In this respect, the said repetition may occur more than once, depending on the need for precision or on other factors which make it necessary to compose an average from a greater quantity of samples.

Thus, the ninth step E9 just consists of the calculation of the average of each one of the parameters measured throughout the performance of the previous steps, including the times in which these were repeated. Thus, the average for line voltage, control module temperature, engine temperature, sum of the engine current and the time taken for the engine to reach the minimum rotation speed value, is obtained.

Finally, as the final step, the method of the present invention uses the averages calculated during the previous step to measure the clothes load in the washing machine. For this tenth step E10 the present invention provides at least two possible embodiments. In a preferable first embodiment the load is determined from the application of the following empirical equation:

$$\text{Load} = \alpha\frac{\sum_{1}^{n} V}{n} + b\frac{\sum_{1}^{n} T_m}{n} + c\frac{\sum_{1}^{n} T_c}{n} + d\frac{\sum_{1}^{n} C}{n} + e\frac{\sum_{1}^{n} T_d}{n}$$

Where, V=Line voltage, Tm=Engine temperature, Tc=Control module temperature, C—engine current, Td=Deceleration time (time that the engine takes to stop after being turned off), n=number of repetitions of the seventh step and a, b, c, d, e are constants obtained empirically through the analysis of tests performed. More precisely, the parameters a, b, c, d, e are weights obtained through tests dictated by the statistical method "Design of Experiment (D.O.E.)".

Figure 6:
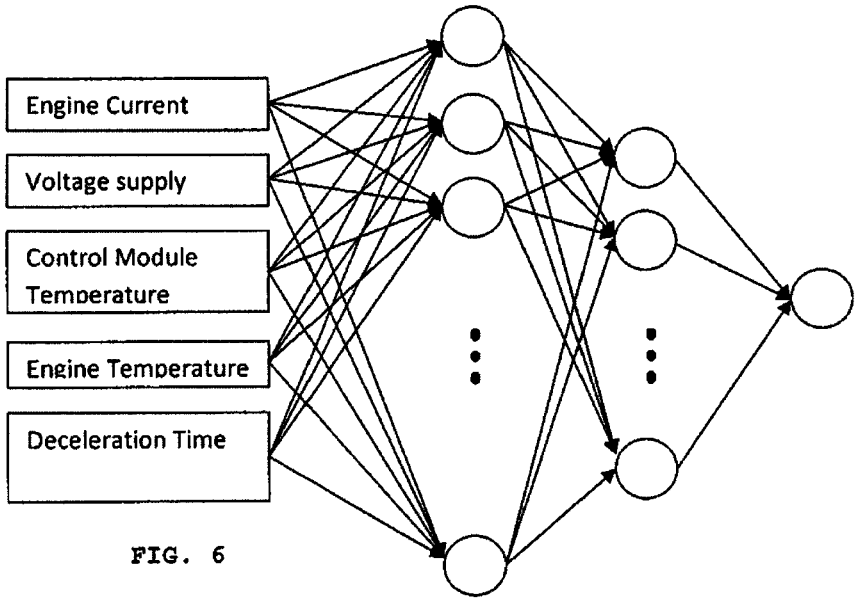
FIG. 6—A diagram of the basic architecture of the neural network used in one of the embodiments of the present invention.

In a second embodiment the load is determined by the use of the average values in a neural network (FIG. 6). The neural network used in this invention has an input layer which comprises the following parameters measured in the previous steps: line voltage, engine temperature, engine control module temperature, sum of the engine current and deceleration time. Besides this the said neural network comprises at least one hidden layer and one output neuron. The weights and the linear coefficients were adjusted, subjecting the network to a set of training data obtained by executing the described algorithm in several clothes washing machines and several times in each machine.

Thus, the load determined by the method of the present invention can be applied to the washing machine's control system to adjust the water level.

As such, as you can see, the method of the present invention is simple and of low cost, achieving, therefore, the objectives that it proposes.

Finally, it is important to note that the nomenclature of ordinal numbers used here to illustrate the sequence of steps may vary depending on the embodiment of the invention. For example, in the case of the embodiment of the present invention that does not comprise the step of the acceleration of the mobile assembly E4, the following steps shall be designated by the ordinal consistent numbers. In this respect, it should not be understood that the designation is a factor which is limitative of the scope of the present invention, as it was adopted solely to facilitate the description of the characteristics of the method for determining loads.

With an example of a preferred embodiment having been described, it should be understood that the scope of the present invention covers other possible variations, it being limited solely by the wording of the attached claims, therein including possible equivalents.

The invention claimed is:

1. A method for determining loads in clothes washing machines, CHARACTERIZED by comprising the following steps:

(E1) Acceleration of a mobile assembly of the washing machine until the mobile assembly reaches a pre-determined rotation speed (E2) Acceleration of the mobile assembly until the mobile assembly reaches a rotation speed faster than the rotational speed in the first step (E1);

(E3) Shutdown of an engine, whereby the engine which turns the mobile assembly is shutdown;

(E4) Acceleration of the mobile assembly until it reaches a pre-determined rotational speed, whereby the rotational speed of the engine which turns the mobile assembly is increased up to a pre-determined rotation speed limit;

(E5) Measurement, whereby parameters regarding the engine are measured;

(E6) Acceleration of the mobile assembly until it reaches a rotational speed faster than the rotational speed in the forth step (E4), whereby the engine current is measured;

(E7) Shutdown of the engine and measurement of the deceleration time, whereby the said engine is turned off and turns via inertia, with the time spent from the shutdown until a pre-determined minimum rotational speed limit is reached, being measured;

(E8) Repetition, whereby, the following steps are repeated at least once: acceleration of the mobile assembly until it reaches a pre-determined rotation speed, whereby the rotational speed of the engine which turns the mobile assembly is increased up to a pre-determined rotation speed limit (E4); Measurement, whereby parameters regarding the engine are measured (E5);

acceleration of the mobile assembly until it reaches a rotational speed faster than the rotational speed in the forth step (E4), whereby the engine current is measured (E6); and shutdown of the engine and measurement of the deceleration time, whereby the said engine is turned off and turns via inertia, with the time spent from the shutdown until a pre-determined minimum rotational speed limit is reached, being measured (E7);

(E9) Calculation of an average of each one of the parameters measured in the previous step (E8); and (E10) Obtainment of the value of clothes load based on the values obtained in the previous step (E9), wherein the value of clothes load is obtained by an equation $$\text{Load} = a\frac{\sum_1^n V}{n} + b\frac{\sum_1^n T_m}{n} + c\frac{\sum_1^n T_c}{n} + d\frac{\sum_1^n C}{n} + e\frac{\sum_1^n T_d}{n}$$

where, V=Line voltage, Tm=Engine temperature, Tc=Control module temperature, C—engine current, Td=Deceleration time (time that the engine takes to stop after being turned off), n=number of repetitions of the seventh step and a, b, c, d, e are constants obtained empirically through the analysis of tests performed;

or by the use of the average values in a neural network having an input layer which comprises the following parameters measured in the previous steps: line voltage, engine temperature, engine control module temperature, sum of the engine current and deceleration time.

2. Method for determining loads in clothes washing machines, in accordance with claim 1, CHARACTERIZED wherein in the first step (E1) a given amount of water is released over the clothes.

3. Method of load measurement in clothes washing machines, in accordance with claim 1, CHARACTERIZED wherein during the fifth step (E5) the speed of the engine which turns the mobile assembly is increased up to a pre-determined rotation speed limit through the application of a variable voltage supply to the engine.

4. Method for determining loads in clothes washing machines, in accordance with claims 1, CHARACTERIZED wherein the parameters measured in the fifth step (E5) are measured with the engine at a pre-determined rotation speed.

5. Method for determining loads in clothes washing machines, in accordance with claims 1, CHARACTERIZED wherein the parameters relating to the engine measured in the fifth step (E5) are: line voltage, engine temperature and engine control module temperature.

6. A method for determining loads in clothes washing machines, CHARACTERIZED by comprising the following steps:

(E1) Acceleration of a mobile assembly of the washing machine until the mobile assembly reaches a pre-determined rotation speed (E2) Acceleration of the mobile assembly until the mobile assembly reaches a rotation speed faster than the speed in the first step (E1);

(E3) Shutdown of an engine, whereby the engine which turns the mobile assembly is shutdown;

(E5) Measurement, whereby parameters regarding the engine are measured;

(E6) Acceleration of the mobile assembly until it reaches a rotational speed faster than the rotational speed in the first step (E1), whereby the engine current is measured;

(E7) Shutdown of the engine and measurement of the deceleration time, whereby the said engine is turned off and turns via inertia, with the time spent from the shutdown until a pre-determined minimum rotational speed limit is reached, being measured, (E8) Repetition, whereby, the following steps are repeated at least once: measurement, whereby parameters regarding the engine are measured (E5); acceleration of the mobile assembly until it reaches a rotational speed faster than the rotational speed in the first step (E1) , whereby the engine current is measured (E6); and shutdown of the engine and measurement of the deceleration time, whereby the said engine is turned off and turns via inertia, with the time spent from the shutdown until a pre-determined minimum rotational speed limit is reached, being measured (E7);

(E9) Calculation of an average of each one of the parameters measured in the previous step (E8); and (E10) Obtainment of the value of clothes load based on the values obtained in the previous step (E9), wherein the value of clothes load is obtained by an equation $$\text{Load} = a\frac{\sum_1^n V}{n} + b\frac{\sum_1^n T_m}{n} + c\frac{\sum_1^n T_c}{n} + d\frac{\sum_1^n C}{n} + e\frac{\sum_1^n T_d}{n}$$

where, V=Line voltage, Tm=Engine temperature, Tc=Control module temperature, C—engine current, Td=Deceleration time (time that the engine takes to stop after being turned off), n=number of repetitions of the seventh step and a, b, c, d, e are constants obtained empirically through the analysis of tests performed;

or by the use of the average values in a neural network having an input layer which comprises the following parameters measured in the previous steps: line voltage, engine temperature, engine control module temperature, sum of the engine current and deceleration time.

7. Method for determining loads in clothes washing machines, in accordance with claim 6, CHARACTERIZED wherein in the first step (E1) a given amount of water is released over the clothes.

8. Method of load measurement in clothes washing machines, in accordance with claim 6, CHARACTERIZED wherein during the fifth step (E5) the speed of the engine which turns the mobile assembly is increased up to a pre-determined rotation speed limit through the application of a variable voltage supply to the engine.

9. Method for determining loads in clothes washing machines, in accordance with claim 6, CHARACTERIZED wherein the parameters measured in the fifth step (E5) are measured with the engine at a pre-determined rotation speed.

10. Method for determining loads in clothes washing machines, in accordance with claim 6, CHARACTERIZED wherein the parameters relating to the engine measured in the fifth step (E5) are: line voltage, engine temperature and engine control module temperature.

* * * * *